US005403173A

United States Patent [19]

Joy

[11] Patent Number: 5,403,173

[45] Date of Patent: Apr. 4, 1995

[54] HOUSING FOR INTERMESHING GEAR PUMP

[75] Inventor: Theodore J. Joy, Mishawaka, Ind.

[73] Assignee: AlliedSignal Inc., Morristown, N.J.

[21] Appl. No.: 207,770

[22] Filed: Mar. 8, 1994

[51] Int. Cl.[6] ..... F01C 21/02

[52] U.S. Cl. ..... 418/73; 418/134; 418/135

[58] Field of Search ..... 418/71, 73, 131, 134, 418/135, 206

[56] References Cited

U.S. PATENT DOCUMENTS 3,043,230 7/1962 Molly ..... 418/73

4,395,207 7/1983 Mänttäri et al. ..... 418/131

*Primary Examiner*—Richard A. Bertsch

*Assistant Examiner*—Charles G. Freary

*Attorney, Agent, or Firm*—Leo H. McCormick, Jr.; Larry J. Palguta

[57] ABSTRACT

A housing for a pump having a cavity therein formed by first and second side walls connected to first and second semicircular end walls. A pair of intermeshing gear members are journaled in a floating bearing and a fixed bearing are located in the cavity. The intermeshing gear members respond to a clockwise rotary torque to pressurize fluid in transporting a fluid from an entrance chamber to a discharge chamber. The fluid in the discharge chamber acts on and urges the floating bearing and fixed bearing into engagement with portions of the first and second semicircular end walls and first side wall to seal the entrance chamber from the discharge chamber. The intermeshing gear members respond to a counterclockwise torque by transporting fluid from the discharge chamber to the entrance chamber to develop an internal fluid pressure. The internal fluid pressure acts on and urges the floating and fixed bearings toward the first and second semicircular end walls and second side wall. The housing has an axial slot that extends from a first point in the first semicircular wall, and through the second side wall to a second point in the second semicircular wall such that the floating and fixed bearing do not seal the discharge chamber from the entrance chamber and as a result the development of the internal pressure is limited to a function of the depth of the axial slot.

7 Claims, 2 Drawing Sheets

HOUSING FOR INTERMESHING GEAR PUMP

This invention relates to a housing for a pump wherein the internal fluid pressure buildup caused by reverse rotation of a pair of intermeshing gear members is limited by an axial slot in a side wall of the housing which prevents the discharge chamber from being sealed from the entrance chamber.

BACKGROUND OF THE INVENTION

In a known gear pump such as disclosed in U.S. Pat. Nos. 5,076,770; 5,252,047; and U.S. patent application Ser. No. 08/207,771 pending, a pair of meshed straight-cut spur gears journaled in cavity of a housing by a floating bearing and a fixed bearing. The floating bearing and fixed bearing and the housing define an entrance chamber and discharge chamber within the cavity. One of the meshed gears is driven or rotated by an external power source, while the other gear is restrained within the housing as an idler and rotates because of its meshing engagement with the externally driven gear. The entrance chamber is connected to a source of fluid through an inlet port and as the meshed gears rotate fluid is drawn into the chamber as adjacent pairs of gear teeth come out of mesh. The fluid drawn-in is transported within the inter-tooth spaces of gear members and as adjacent pairs of gear teeth come into mesh, fluid is displaced through an exit port associated with the discharge chamber. Close tolerances, various seals and the mesh of the gears prevents the commingling of fluid between the entrance chamber and discharge chamber. These pumps operate in a satisfactory manner except when a reverse input rotary torque is applied to the pair of intermeshing gears. The intermeshing gears respond to the reverse input rotary torque by transporting fluid from the discharge chamber to the entrance chamber and as a result an internal fluid pressure buildup occurs. This internal fluid pressure acts on the floating bearing and fixed bearing to seal the discharge chamber from the entrance chamber and in some instances the intermeshing gears actually engage and cut material from the housing adjacent the exit port. If such material is not removed from the system, the material may later affect the operation of other components in the system and such internal pressure may also have an adverse affect on other components in the system.

SUMMARY OF THE INVENTION

In the present invention, a housing for a pump has an axial slot which prevents excessive internal fluid pressure build up through a reverse input torque while at the same time preventing a pair of intermeshing gear members from engaging the housing. The housing has a cavity with substantially parallel first and second side walls connected to each other by first and second semicircular end walls. The first side wall has an entrance port and the second side wall has a discharge port. The pair of intermeshing gear members are journaled in a fixed bearing and a floating bearing and are located in the cavity. The pair of intermeshing gear members are rotated in response to a clockwise input torque to transport fluid from an entrance chamber to a discharge chamber. An increased pressure in the fluid occurs as the fluid is transported from the entrance fluid pressure to the discharge chamber. The discharge fluid pressure is freely communicated through the axial slot to act on and move the floating and fixed bearings into engagement with portions of the first and second semicircular end walls connected to the first side wall and into engagement with the pair of gear members to seal the entrance chamber from the discharge chamber to assure that fluid communication to the discharge chamber only occurs through the pair of intermeshing gear members. The intermeshing gear members also respond to a reverse or counterclockwise input torque by rotating and transporting fluid from the discharge chamber to the entrance chamber. As fluid is transported from the discharge chamber to the entrance chamber, an internal fluid pressure develops in the fluid. Thus internal fluid pressure acts on and moves the floating and fixed bearing into engagement with portions of the first and second semicircular end walls connected to the second side wall however the axial slot prevents the fixed and floating bearings from sealing the discharge chamber from the entrance chamber and thereby limits the development of the internal fluid pressure. In addition, the axial slot has a depth such that the pair of intermeshing gears do not engage and cut material from the housing.

This invention provides for a simple construction of the components of a pump which limits that internal fluid pressure build up caused by a reverse input torque applied to a pair of intermeshing gears while at the same time preventing the intermeshing gears from engaging and cutting material from the housing which could have an adverse effect on the operation of the system later supplied with pressurized fluid from the pump.

DETAILED DESCRIPTION OF THE INVENTION

Figure 1:
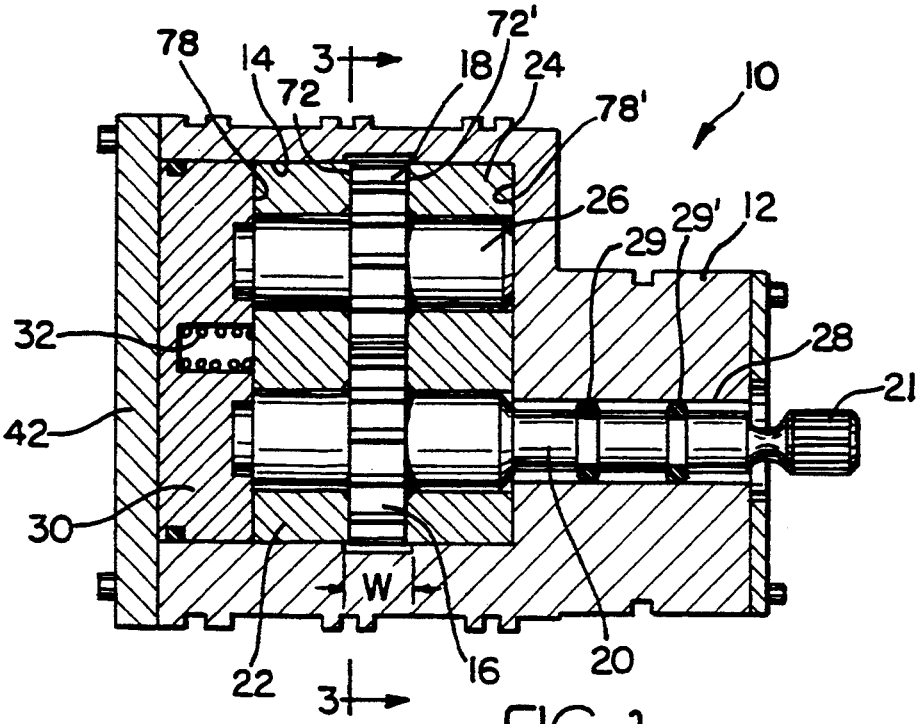
FIG. 1 is a sectional view of a pump made according to the principals of the present invention.

The gear pump 10 shown in FIG. 1 has a housing 12 with a cavity 14 located therein for retaining a pair of intermeshing gear members 16 and 18. Gear member 16 has a shaft 20 which is journaled in a floating bearing 22 and a fixed bearing 24 while gear member 18 which is driven by gear member 16 has a shaft 26 which is also journaled in the floating bearing 22 and fixed bearing 24. A spacer member 30 is located in cavity 14 by an end fixture 42 which is fixed to housing 12. Spacer member 30 retains a spring 32 which acts on the floating bearing 22 to provide an initial clamping force which urges the floating bearing 22 into engagement with the pair of intermeshing gears 16, 18 and the intermeshing gears 16, 18 into engagement with fixed bearing 24 to initially define an entrance chamber 34 adjacent the entrance port 36 and a discharge chamber 38 adjacent the exit port 40. Shaft 20 engages seals 29, 29' and extends through an opening 28 in housing 12 to seal cavity 14. Shaft 20 receives clockwise rotary torque from a source to transport fluid from entrance chamber 34 to discharge chamber 38 and increase the fluid pressure therein before flowing from exit port 40. Similarly shaft 20 can also receive counterclockwise rotary torque to reverse the flow of fluid from the discharge chamber 38 toward the entrance chamber 34 and the present invention limits the fluid pressure that develops from such counterclockwise rotary torque.

Figure 2:
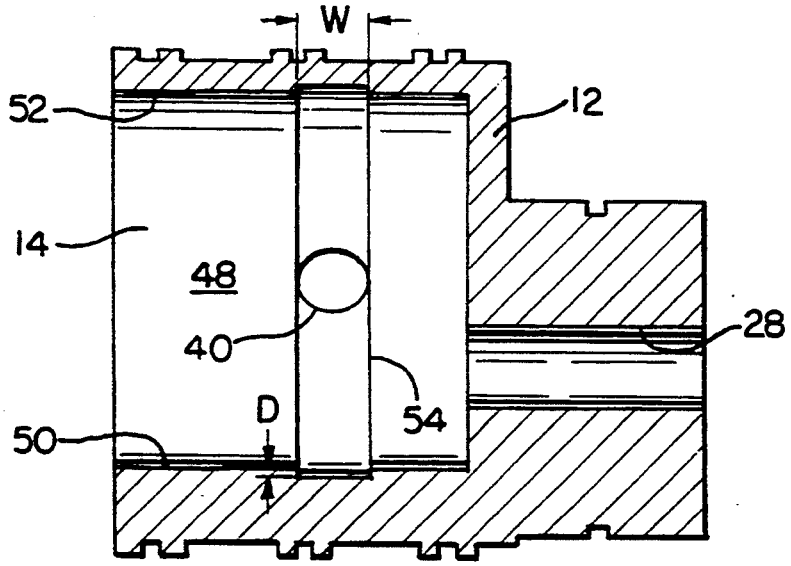
FIG. 2 is sectional view of the housing of the pump of FIG. 1 showing the exit port for the discharge chamber.
Figure 3:
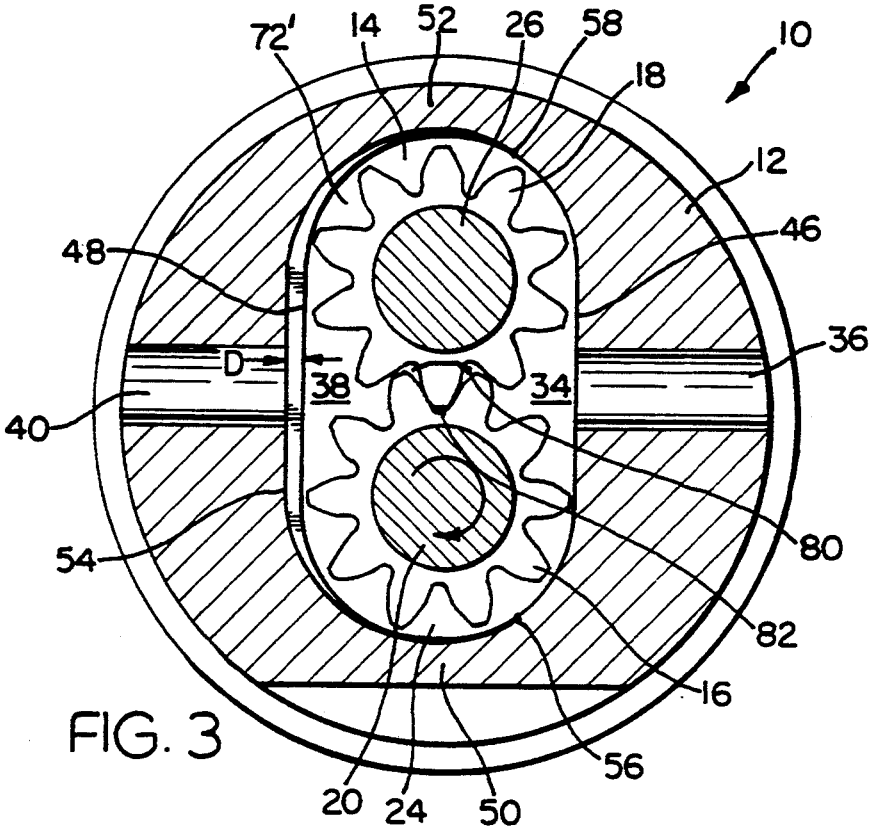
FIG. 3 is a sectional view taken along lines 3—3 of FIG. 1 showing the relationship of the pair of intermeshing gear members in the housing.

In more particular detail, the housing 12 as best shown in FIGS. 2 and 3 has a first side wall 46 and a second side wall 48 which are joined together by a first semicircular end wall 50 and a second semicircular end wall 52 to define cavity 14. The housing 12 has an axial slot 54 that follows a path that from a first point 56 on the first semicircular end wall 50 through the second side wall 48 to a second point 58 in the second end wall 52. The first point 56 is located at a point between 45 and 60 degrees from the tangent of the first semicircular end wall 50 and first side wall 46 while the second point is located at a point between 45 and 60 degrees from the tangent of the second semicircular end wall 52 and the first side wall 46. The axial slot 54 which is selected to be a uniform depth D after an initial transition of between 0.02 and 0.03 inches and a width W that is greater than the width of the pair of intermeshing gear members 16, 18. Width W is effectively the width of the intermeshing gears 16, 18 plus the depth of slots 68, 70 in the floating bearing 22 and fixed bearing 24.

Figure 5:
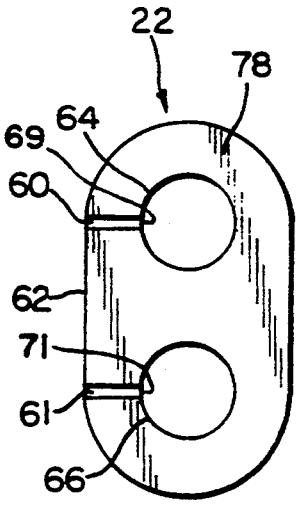
FIG. 5 is a view taken along line 5—5 of FIG. 4.
Figure 4:
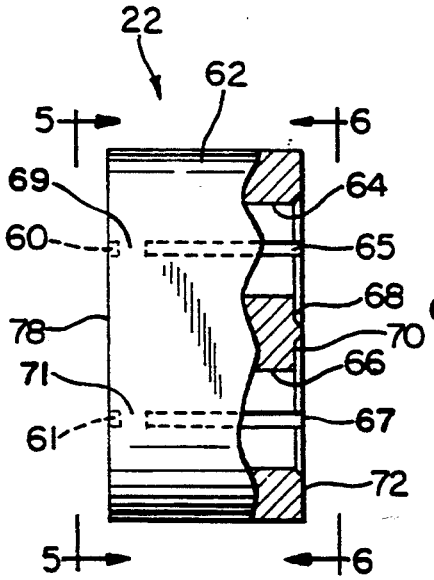
FIG. 4 is a side view and partial sectional view of a bearing for use in the pump of FIG. 1.
Figure 6:
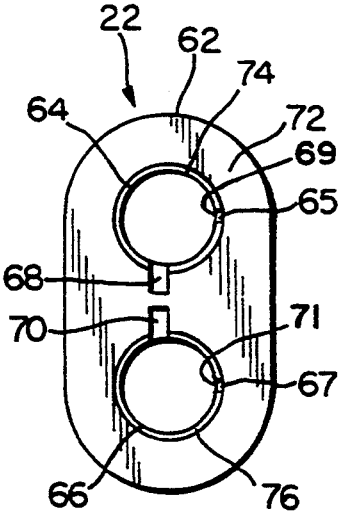
FIG. 6 is a view taken along line 6—6 of FIG. 4.

Floating bearing 22 and fixed bearing 24 are identical with floating bearing 22 illustrated in FIGS. 4, 5 and 6. Bearing 22 has a housing 62 with an oval shape which is substantially identical to cavity 14, axial bores 64 and 66 for retention of shafts 26 and 20, respectively, slots 68, 70 in face 72 connected to chamfers 74, 76, axial slots 65, 67 and radial slots 60, 61 in face 78. Axial slots 65, 67 only extend about 80 percent through the axial bores 64, 66, respectively such that barriers 69 and 71 are formed between slots 65, 67 and radial slots 60, 61. Thus the flow path between face 72 and face 78 has a slight barrier and any particles or debris in the fluid is retained in axial slots 65, 67 rather than being directly communicated to the discharge chamber 38. Because of the temperature and wear characteristics, these bearings are made from a carbon graphite material however in certain situations such bearing may be made from brass alloys.

MODE OF OPERATION OF THE INVENTION

When an input torque is applied to the end 21 of shaft 20, gear 16 rotates and gear member 18 follows because of the mesh of these gears. Fluid presented to the entrance chamber 34 through inlet port 36 is picked up and carried around in the inter-tooth spaces of the intermeshing gears to a discharge chamber for distribution through exit port 40. Fluid communication from the discharge chamber 38 toward the entrance chamber is substantially prevented as the discharge fluid acts on and urges the floating bearing 22 and fixed bearing 24 into engagement with the first 50 and second 52 end walls and the first side wall 46 to seal the discharge chamber 38 from the entrance chamber 34 as is well known in the prior art. The location of the first point 56 and second point 58 for the starting and ending of the axial slot 54 is selected at about one to two and one half teeth on gears 16 and 18 which is between 45 and 60 from the tangent for side wall 46 and the first 50 and second 52 semicircular end to assure that a good seal is established between the oval bearings and housing 12. As gears 16 and 18 rotate, an intermesh volume of fluid is trapped between the teeth such that a chamber 80 is sequentially formed as the teeth approach full mesh at point 82. This trapped volume of pressurized fluid flows from such chambers 80 to cool shaft 26 by way of slot 68, chamfers 74, axial slot 65 and to cool shaft 20 by way of slot 70, chamfer 76, axial slot 67. Since the pressure of the fluid present in the axial slots 65 and 67 is slightly greater than the discharge fluid pressure, it flows past the controlled barriers 69 and 71 to the discharge chamber 38 by way of radial slots 60,61. The discharge fluid pressure caused by the resistance to the flow from the exit port 40 is a function of several variables including speed of rotation and losses produced by the flow of fluid between engagement plane of bearings 22 and 24 and the pair of intermeshing gears 16, 18. However since the discharge fluid is freely communicated to both the floating 22 and fixed 24 bearings it acts on and provides a clamping force that assists spring 32 in urging face 72,72' on the bearings into engagement with the pair of intermeshing gears 16 and 18 to assure that the entrance chamber 34 is sealed from the discharge chamber 38. This pump 10 performs in an adequate manner to meet the required operational specifications and with the axial slot 54 located housing 12 limits the build up of internal fluid pressure that can occur when a counterclockwise torque is applied to shaft 20.

Shaft 20 responds to a counter-clockwise torque by rotating gears 16 and 18 transport fluid from discharge chamber 38 toward entrance chamber 34. As shaft 20 is rotated, an internal fluid pressure build up occurs in the transported fluid such that the internal fluid pressure in the entrance chamber 34 is greater than in the discharge charge chamber 38. This internal fluid pressure acts on and urges the floating 22 and fixed 24 bearings toward the first semicircular end 50 and second semicircular end 52 connected to the second side wall 48 however no sealing occurs since slot 54 allows free communication between the discharge chamber 38 and entrance chamber 34. Thus, development of the internal fluid pressure is limited to a value which would not adversely effect the components of pump 10 or the system which supplies the pump 10 through inlet port 36.

I claim:

1. A housing for a pump having a cavity with substantially parallel first and second side walls connected by first and second semicircular end walls, said first side wall having an entrance port and said second side wall having a discharge port, said cavity retaining a pair of intermeshing gear members journaled in a fixed bearing and a floating bearing, said pair of intermeshing gear members rotating in response to a clockwise input torque to transport fluid from an entrance chamber to a discharge chamber and increase pressure in said fluid from an entrance fluid pressure to a discharge fluid pressure, said housing being characterized by an axial slot that begins at a first point in said first semicircular end wall, extends through said second side wall and ends at a second point in said second semicircular end wall, said axial slot having a width which is greater than an axial width of said intermeshing gear members, said discharge fluid pressure being freely communicated through said axial slot to act on and move said floating and fixed bearings into engagement with portions of said first and second semicircular end walls connected to said first side wall and into engagement with said pair of intermeshing gear members to seal said entrance chamber from said discharge chamber to assure that fluid communication to said discharge chamber only occurs by way of said pair of intermeshing gear members in response to said clockwise input torque, said intermeshing gears being responsive to a counter-clockwise input torque by rotating and transporting fluid from said discharge chamber to said entrance chamber and as a result developing an internal fluid pressure in fluid transported from said discharge chamber to said entrance chamber, said internal fluid pressure acting on and moving said floating and fixed bearings into engagement with portions of said first and second semicircular end walls connected to said second side wall, said axial slot preventing said fixed and floating bearings from sealing said discharge chamber from said entrance chamber to limit the development of said internal fluid pressure.

2. In the housing as recited in claim 1 wherein said first point is located in said first semicircular end wall and said second point is located in said second semicircular end wall, said first and second points being located at an angle between 45 and 60 degrees from a tangent of said first side wall.

3. In the housing as recited in claim 1 wherein said axial slot in said housing has a depth in said second side wall of between 0.02 to 0.03 inches.

4. In the housing as recited in claim 1 wherein said first and second axial bores in said floating and fixed bearings each have a restricted axial slot through which cooling discharge fluid is communicated to said discharge chamber.

5. In the housing as recited in claim 1 wherein said cavity is essentially an oval with said floating and fixed bearings having a complementary shape.

6. In the housing as recited in claim 5 wherein said axial slot in said housing has a depth sufficient to prevent engagement of said pair of intermeshing gear members with said second side wall when said internal fluid pressure urges and moves said floating and fixed bearings into engagement with said first and second semicircular end walls and said second side wall.

7. In the housing as recited in claim 1 wherein said said discharge pressure uniformly acts on and urges the floating and fixed bearings into engagement with said housing to seal said entrance chamber from the discharge chamber.

* * * * *